US010534286B1

(12) United States Patent
Stafford et al.

(10) Patent No.: US 10,534,286 B1
(45) Date of Patent: Jan. 14, 2020

(54) THERMAL ELEMENTS FOR ELECTROSTATIC PROCESS UNITS

(71) Applicant: Toshiba TEC Kabushiki Kaisha, Shinagawa-ku (JP)

(72) Inventors: Don W. Stafford, Lexington, KY (US); Donn D. Bryant, Lexington, KY (US)

(73) Assignee: Toshiba TEC Kabushiki Kaisha, Shinagawa-ku (JP)

( * ) Notice: Subject to any disclaimer, the term of this patent is extended or adjusted under 35 U.S.C. 154(b) by 0 days.

(21) Appl. No.: 16/171,965

(22) Filed: Oct. 26, 2018

(51) Int. Cl.
*G03G 15/08* (2006.01)
*G03G 21/20* (2006.01)

(52) U.S. Cl.
CPC ..... *G03G 15/0812* (2013.01); *G03G 21/206* (2013.01)

(58) Field of Classification Search
CPC ..... G03G 15/0812; G03G 21/206
See application file for complete search history.

(56) References Cited

U.S. PATENT DOCUMENTS 4,963,936 A * 10/1990 Carter ..... G03G 15/0896 399/119
8,135,315 B2 3/2012 Ozeki et al.
8,768,198 B2 7/2014 Yano
2002/0191982 A1* 12/2002 Tsukamoto ..... G03G 15/104 399/94

FOREIGN PATENT DOCUMENTS

JP 2006301467 A * 11/2006
JP 2007226148 A * 9/2007
JP 2009103785 A * 5/2009

OTHER PUBLICATIONS

Mark Pollock, Grafoil Flexible Graphite, pp. 15. (Year: 2002).*

* cited by examiner

*Primary Examiner* — Susan S Lee
(74) *Attorney, Agent, or Firm* — Ulmer & Berne LLP

(57) ABSTRACT

A system and method for passively cooling electrostatic process units includes a thermally conductive housing and a doctor bar. The thermally conductive housing is disposed over the developer roller of the electrostatic process unit and conducts heat from inside the electrostatic process unit to a plurality of ribs disposed on along the length of the electrostatic process unit. Heat transferred to the plurality of ribs is dissipated through convection with surrounding air. Heat from the thermally conductive housing is also transferred through conduction to a printer chassis through contact of the thermally conductive housing with the printer chassis. The doctor bar conducts heat from the junction of the doctor blade and the developer roller to a plurality of ribs disposed on the doctor bar where the heat is dissipated through convection with the surrounding air.

18 Claims, 4 Drawing Sheets

THERMAL ELEMENTS FOR ELECTROSTATIC PROCESS UNITS

TECHNICAL FIELD

This application relates generally to removing heat from electrostatic process units (EPUs), and more particularly to thermal elements for cooling EPU components.

BACKGROUND

Document processing devices include printers, copiers, scanners and e-mail gateways. More recently, devices employing two or more of these functions are found in office environments. These devices are referred to as multifunction peripherals (MFPs) or multifunction devices (MFDs). As used herein, MFP means any of the forgoing.

An electrostatic process unit (EPU) in many toner-based printers and multifunction peripherals performs the printing function. The EPU typically comprises a photoconductive drum, and a developer roller, and can include a charge unit, a toner hopper, a semiconductor laser, and developer among other components as would be known in the art. The EPU can be configured as a field replaceable unit or can be part of a self-contained compact cartridge that includes the toner. Using magnetic and electrostatic forces, the developer roller and the photoconductive drum transfer toner from a toner hopper to a sheet of paper where it is fused by heat to the paper. After the photoconductive drum transfers toner to the paper, a cleaner blade in the EPU removes residual toner and paper dust from the photoconductive drum.

EPUs are disposed inside printers and can become hot during normal operation, both due to the EPU operation itself and due to the operations of other components inside the printer chassis. Excessive heat inside an EPU can degrade the toner present in the EPU. Heat also increases stresses on EPU components which shortens the useful lifespan of EPUs and increases the frequency of maintenance that is required to maintain printers in an operational state.

BRIEF DESCRIPTION OF THE DRAWINGS

Various embodiments will become better understood with regard to the following description, appended claims and accompanying drawings wherein:

DETAILED DESCRIPTION

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

In an example embodiment a passively cooled electrostatic process unit includes a thermally conductive developer housing that is disposed over the developer roller of an electrostatic process unit of a printer. The developer housing is configured to transfer heat from inside the electrostatic process unit to a plurality of ribs disposed on the developer housing where the heat is transferred by convection to surrounding air. The developer housing is also configured to transfer heat from inside the electrostatic process unit to the chassis of the printer through conduction. A doctor bar of the electrostatic process unit similarly can conduct heat from the junction of the doctor blade and developer roller to a plurality of ribs disposed on the doctor bar where the heat is dissipated through convection.

In toner-based electro-photographic printers, the electrostatic process unit, or EPU, selectively transfers toner from an associated toner hopper to a transfer belt for printing images and text onto paper in accordance with user print jobs. EPU components can become hot during normal print operations, especially during periods of frequent use. EPUs are disposed inside printers in an enclosed space. As a result EPUs can become overheated both from heat generated by operation of the EPU itself and from heat generated by nearby components in the printer. Excessive heat can degrade toner present in the EPU which can result in lower quality images and other problems. High temperatures also increase stress on EPU components, which can reduce the useful life of the EPU and increase future maintenance needs.

To prevent overheating, printers can reduce printing speeds in order to limit the amount of heat generated by the EPU. Printers also can incorporate additional fans and motors to circulate air and cool components, but that can increase costs and complexity and motors may need to be controlled by a suitable motor controller. Compact printers are especially prone to overheating due to the close proximity of components to one another. However, in compact printers it may be impractical to add dedicated fans and motors to cool components as these fans and motors take up additional space and increase costs.

Figure 1:
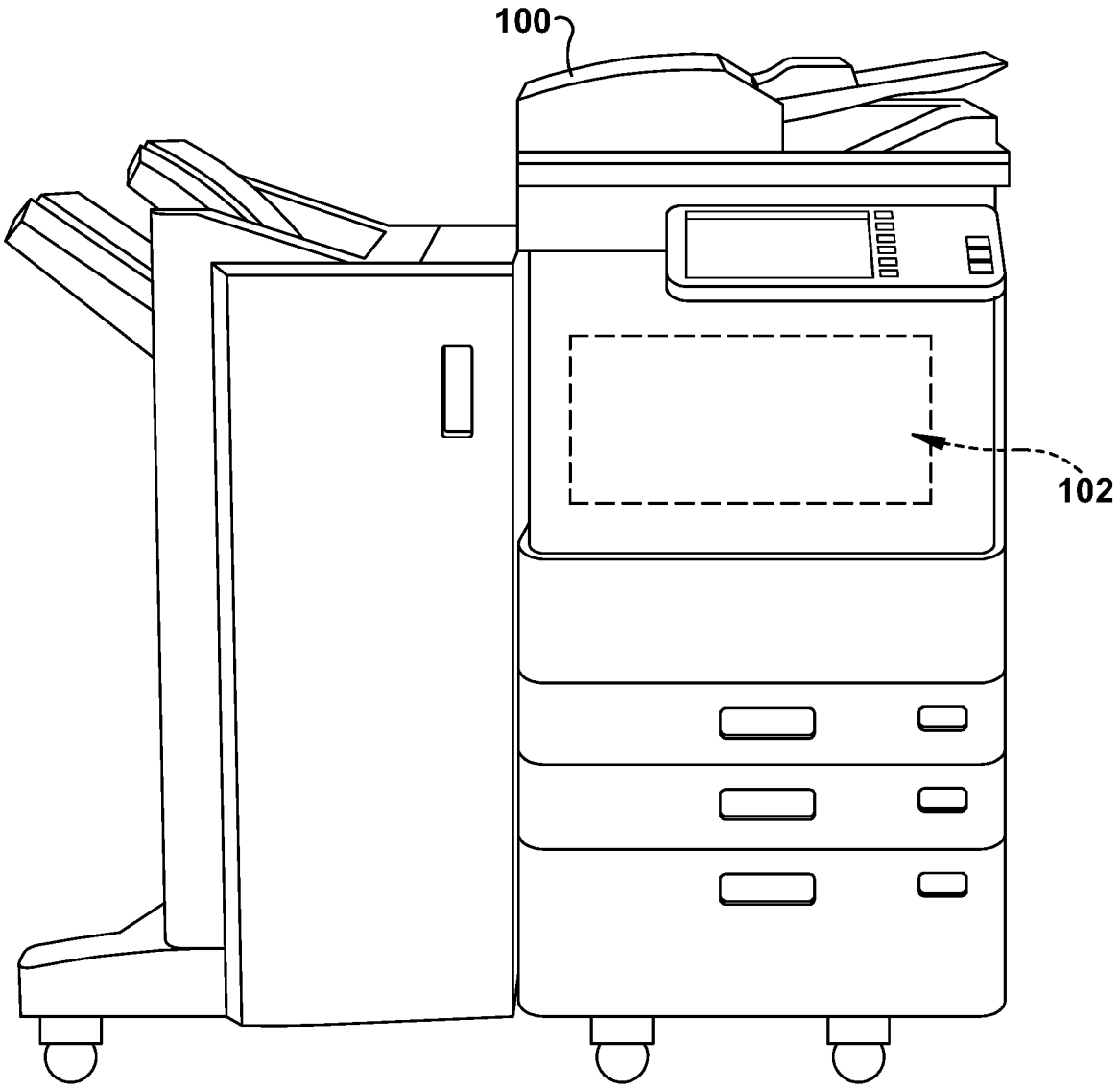
FIG. 1 is a block diagram of a multifunction peripheral.

With reference to FIG. 1, an example multifunction peripheral (MFP 100) is presented. The MFP 100 includes electrostatic-based, or toner-based, printing hardware 102 for performing printing operations as would be understood in the art.

Figure 2A:
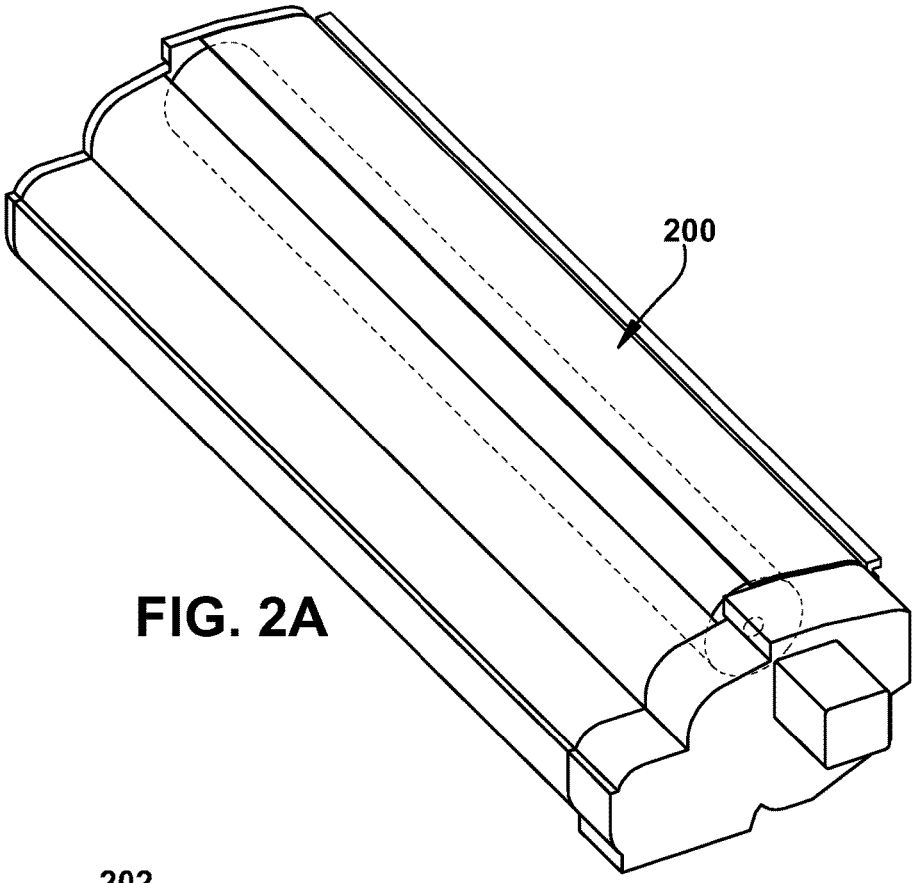
FIG. 2A is a diagram of an example electrostatic process unit.
Figure 2B:
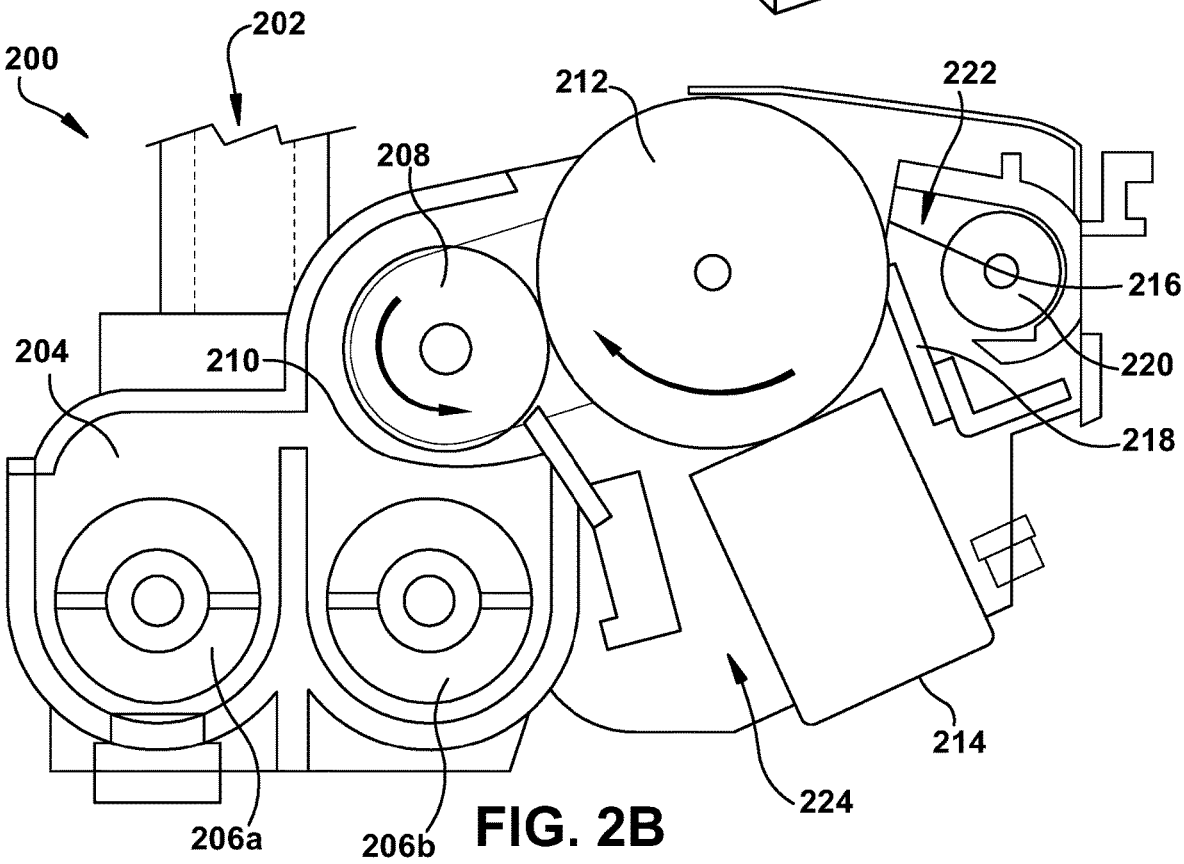
FIG. 2B is a diagram of example components of an electrostatic process unit.

With reference to FIGS. 2A and 2B, diagrams of an electrostatic process unit 200 for a multifunction peripheral are presented. The electrostatic process unit 200 can be a component of the printing hardware 102 of the multifunction peripheral 100 of FIG. 1. For example, the electrostatic process unit 200 can be a field-serviceable component that is removably mounted on rails in the multifunction peripheral 100. The rails can be constructed of a metal such as steel or aluminum for durability and heat dissipation.

The electrostatic process unit 200 receives toner 202 into a toner hopper 204 of a developer unit that includes mixers 206*a* and 206*b*. Toner 202 from the toner hopper 204 is picked up by the developer 208 that rotates towards a doctor blade 210. The doctor blade 210 removes excess toner 202 from the developer 208 leaving a thin evenly distributed layer of toner 202 on the developer 208. The developer 208 rotates towards the photoconductive drum 212. The photoconductive drum 212 is charged by a charger unit 214 which can include a primary charge roller (not shown), and a laser (not shown) associated with the printer produces the image to be printed on the photoconductive drum 212. The high voltages associated with charging and selectively removing charge via a laser cause the electrostatic process unit 200 to develop substantial amounts of heat during use.

As the photoconductive drum 214 rotates, toner 202 on the photoconductive drum 214 is selectively pulled from developer 208 to the photoconductive drum 212 in accordance to the image to print. The photoconductive drum 212 transfers the toner 202 to a transfer belt (not shown) and then to paper (not shown) after which the toner 202 is permanently fused to the paper by a fusing assembly (not shown). After transferring toner 202 to the transfer belt, the photoconductive drum 212 continues to rotate towards a cleaner blade 218 that removes any residual toner and other particles that remain on the photoconductive drum 212. A recovery blade 216 prevents removed toner and other particles from escaping from this section of the developer cavity 222 into other parts of the developer cavity 224. An auger 220 moves waste toner and other particles out of the EPU to a suitable waste receptacle.

Figure 3A:
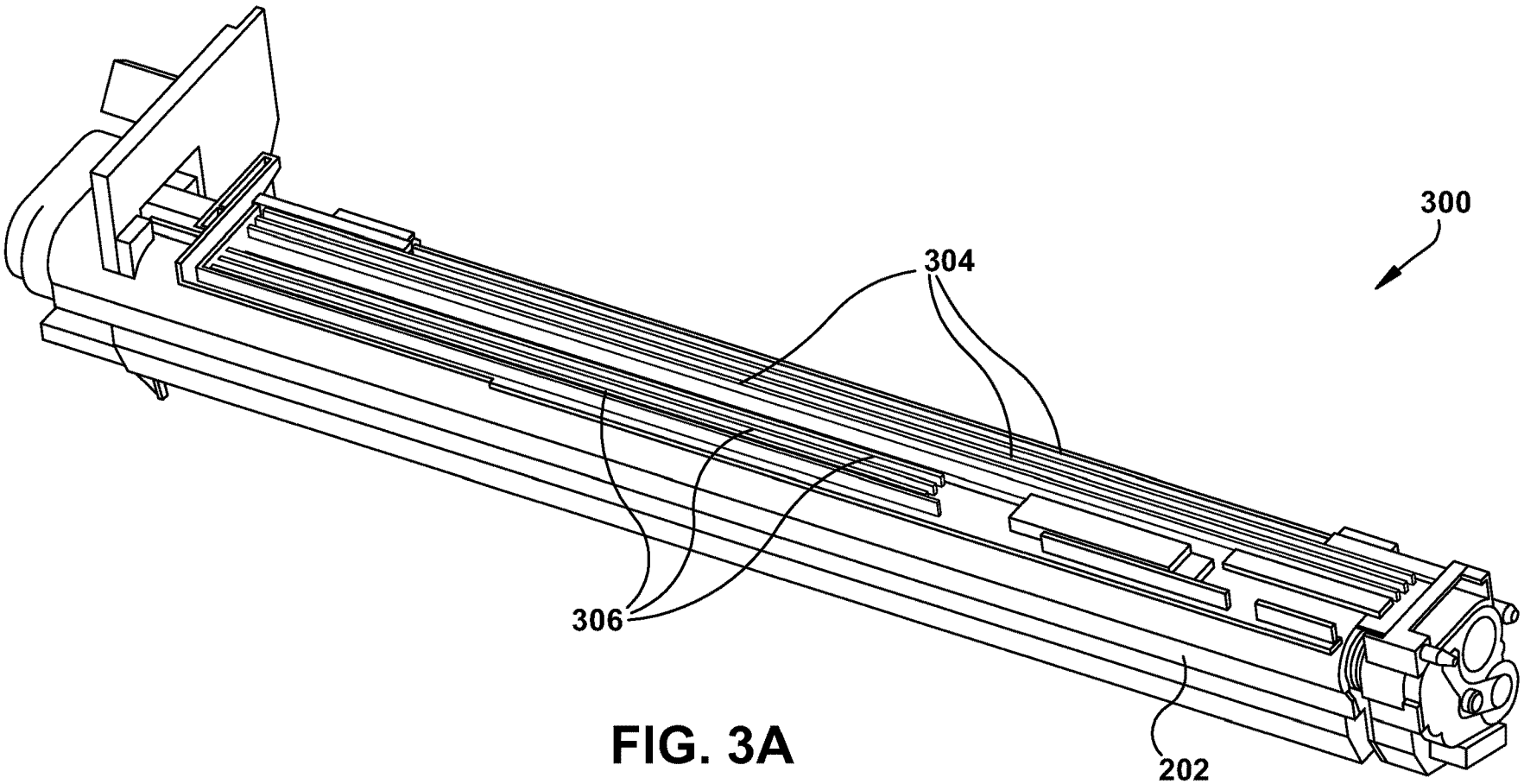
FIG. 3A is a first diagram of an example electrostatic process unit with thermal elements.
Figure 3B:
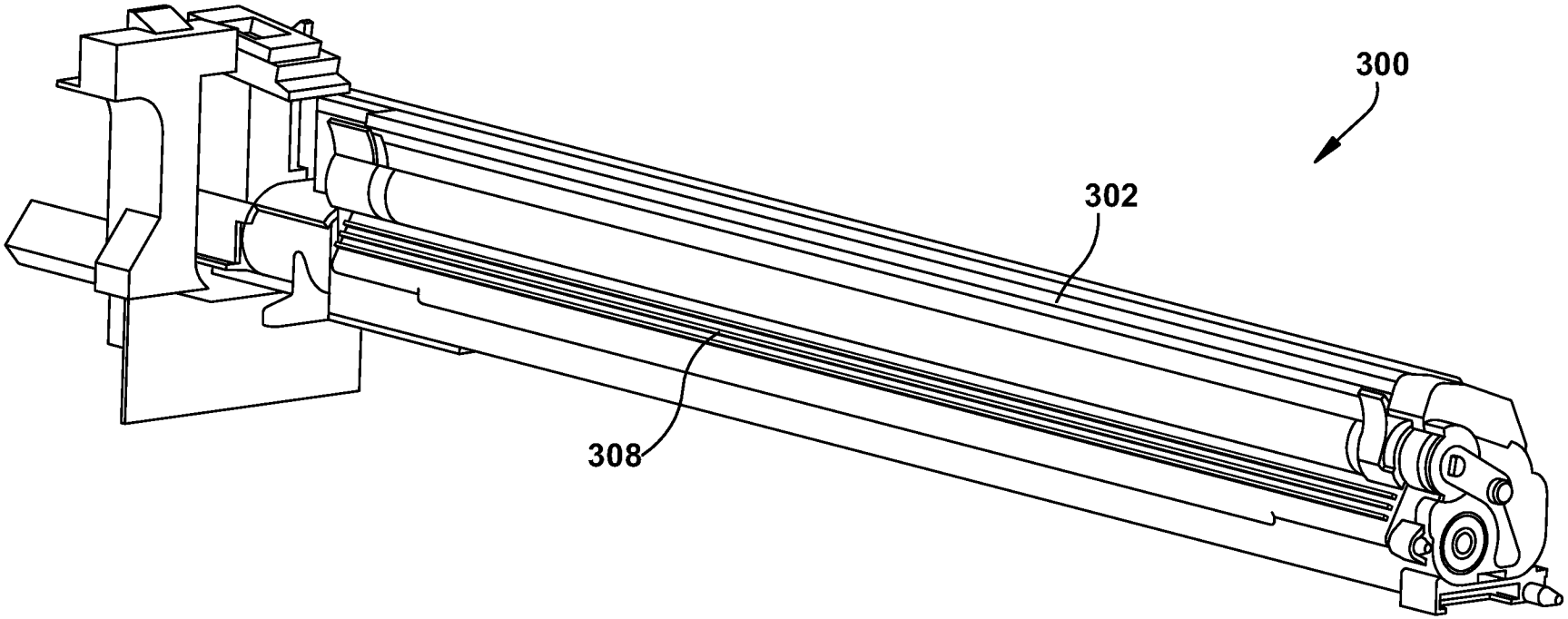
FIG. 3B is a second diagram of an example electrostatic process unit with thermal elements.

With reference to FIGS. 3A and 3B, an electrostatic process unit 300 with thermal elements is presented. The electrostatic process unit 300 can include a thermal housing 302, a first set of ribs 304 on the developer housing, a second set of ribs 306 on the developer housing, and a third set of ribs 308 on the doctor bar or doctor blade.

In certain embodiments, the thermal housing 302 is comprised of a thermally conductive plastic. The thermal housing 302 conducts heat from the interior of the electrostatic process unit 300 through the thermally conductive plastic to anything that is in contact with the thermal housing 302. For example, when the electrostatic process unit 300 is removably mounted on rails in a multifunction peripheral, the portions of the thermal housing 302 that contact the rails can conduct heat to the rails which can be dissipated by the metal in the chassis of the multifunction peripheral. Therefore, design choices for the rails can assist in determining how well heat is transferred from the electrostatic process unit 300 to the chassis. For example, aluminum rails with large contact areas can transfer more heat than smaller steel or plastic rails. In certain embodiments, the thermal housing 302 includes metal portions, for example metal contact areas comprised of aluminum, copper, or copper aluminum alloys to improve heat transfer from electrostatic process unit 300.

In certain embodiments, for example as illustrated in FIG. 3A, the developer housing can include a first set of ribs 304 and optionally a second set of ribs 306. The ribs 304, 306 can be comprised of the same or different materials as the thermal housing 302. For example, the ribs 304, 306 can be a plurality of periodically spaced projections or fins that run approximately the length of the electrostatic process unit 300. The ribs 304, 306 operate as heat sinks and substantially increase the surface area of the developer housing, which allows convection through the air to remove heat from the electrostatic process unit 300.

In certain embodiments, for example as illustrated in FIG. 3B, the doctor bar can be extended outside the developer housing and can include a third set of ribs 308. Doctor bars are typically made from metal which is generally good at conducting heat. By extending the doctor bar, the additional material acts as a heat pipe to transfer substantial amounts of heat from the interior of the electrostatic process unit 300 to outside the developer housing. The third set of ribs 308 can be constructed from the same or different materials as the doctor bar, for example aluminum, copper, steel, other metals, or thermally conductive plastic. The third set of ribs 308 can be a plurality of periodically spaced projections or fins that run approximately the length of the doctor bar of the electrostatic process unit 300. The third set of ribs 308 operates as a heat sink to cool the doctor bar and reduce the developer temperature via the doctor blade/developer interface.

In various embodiments, the electrostatic process unit 300 can use any suitable number of ribs 304, 306, 308, any suitable choice of rib placement and orientation, and any suitable material choices to remove heat from the interior of the electrostatic process unit 300. Advantageously, the thermal housing 302 and ribs 304, 306, 308 provide a simple, passive, low-cost solution for cooling components of the electrostatic process unit 302 without requiring separate fans and motors. By comparison, adding separate fans and motors would not only take up valuable space inside the printer, but would also require control by a suitable motor controller, thereby increasing both cost and complexity. Advantageously, existing electrostatic process units 300 can be retrofitted to include the thermal housing 302 and ribs 304, 306, 308. Advantageously, the thermal housing 302 and ribs 304, 306, 308 can be configured to substantially conform to the footprint of existing electrostatic process units 300 in the field, thereby allowing existing electrostatic process units 300 to be replaced with electrostatic process units 300 that include thermal housing 302 and ribs 304, 306, 308 6.

In light of the foregoing, it should be appreciated that the present disclosure significantly advances the art of cooling electrostatic process units. While example embodiments of the disclosure have been disclosed in detail herein, it should be appreciated that the disclosure is not limited thereto or thereby inasmuch as variations on the disclosure herein will be readily appreciated by those of ordinary skill in the art. The scope of the application shall be appreciated from the claims that follow.

What is claimed is:

1. An electrostatic process unit, comprising:

a developer roller disposed in an interior portion of the electrostatic process unit;

a doctor bar that comprises a doctor blade disposed along a first length of the doctor bar; and a developer housing disposed over at least part of the developer roller, wherein the developer housing is thermally conductive and configured to transfer heat from the interior portion of the electrostatic process unit, wherein the doctor blade is configured to be in close proximity to the developer roller, and wherein the doctor bar is configured to conduct heat from the junction of the doctor blade and the developer roller and dissipate heat along a second length of the doctor bar.

2. The electrostatic process unit of claim 1, wherein the developer housing substantially comprises a thermally conductive plastic.

3. The electrostatic process unit of claim 1, wherein the electrostatic process unit is configured to be disposed in a multifunction peripheral, and wherein the developer housing is configured to transfer heat to the multifunction peripheral of the printer through conduction.

4. The electrostatic process unit of claim 3, wherein at least a portion of the developer housing is configured to contact the multifunction peripheral, and wherein heat is substantially transferred from the developer housing to the multifunction peripheral through conduction.

5. The electrostatic process unit of claim 1, further comprising:

a plurality of ribs disposed on the developer housing, wherein the plurality of ribs are configured to dissipate heat to air outside of the electrostatic process unit substantially through convection.

6. The electrostatic process unit of claim 1, wherein the plurality of ribs are disposed substantially along a length of the electrostatic process unit.

7. The electrostatic process unit of claim 1, wherein the doctor bar further comprises a plurality of ribs disposed substantially along a second length of the doctor bar, and wherein the plurality of ribs are configured to dissipate heat substantially through convection with surrounding air.

8. An electrostatic process unit, comprising:

a developer roller disposed in an interior portion of the electrostatic process unit; and a doctor bar that comprises a doctor blade disposed along a first length of the doctor bar, wherein the doctor blade is configured to be in close proximity to the developer roller, wherein the doctor bar is configured to conduct heat from the junction of the doctor blade and the developer roller to a second length of the doctor bar where the heat is dissipated.

9. The electrostatic process unit of claim 8, wherein the doctor bar further comprises a plurality of ribs disposed substantially along the second length of the electrostatic process unit, and wherein the plurality of ribs are configured to dissipate heat substantially through convection with surrounding air.

10. The electrostatic process unit of claim 9, further comprising:

a developer housing disposed over at least part of the developer roller, wherein the developer housing is thermally conductive, wherein the developer housing is configured to absorb radiant and convective heat associated with the developer roller and conduct the heat outside of the electrostatic process unit.

11. The electrostatic process unit of claim 10, further comprising:

a plurality of ribs disposed on the developer housing, wherein the plurality of ribs are configured to dissipate the heat conducted through the developer housing to air outside of the electrostatic process unit substantially through convection.

12. The electrostatic process unit of claim 11, wherein the developer housing and the plurality of ribs are substantially comprised of a thermally conductive plastic.

13. A method of passively cooling an electrostatic process unit, comprising:

performing a print operation on a print engine that includes the electrostatic process unit;

generating waste heat in the electrostatic process unit as a result of performing the print operation;

absorbing, by a thermally conductive housing of the electrostatic process unit, waste heat from inside the electrostatic process unit;

conducting, by the thermally conductive housing, at least a portion of the absorbed heat to a plurality of ribs disposed on the outside of the thermally conductive housing; and dissipating heat, by the plurality of ribs, from the electrostatic process unit to air that is in proximity to the plurality of ribs;

transferring, by a doctor blade that is in close proximity to a developer roller, heat associated with the developer roller to a doctor bar; and dissipating heat by the doctor bar to cool the developer roller and the electrostatic process unit, wherein the doctor blade is disposed along a first length of the doctor bar.

14. The method of claim 13, wherein the heat is dissipated passively by the plurality of ribs.

15. The method of claim 13, wherein the thermally conductive housing is associated with a developer roller of the electrostatic process unit, wherein the thermally conductive housing is disposed in proximity to the developer roller, and wherein the plurality of ribs are disposed substantially along a length of the thermally conductive housing opposite the developer roller.

16. The method of claim 13, wherein the doctor bar includes a second plurality of ribs disposed substantially along a second length of the doctor bar, and wherein the second plurality of ribs are configured to dissipate heat substantially through convection with surrounding air.

17. The method of claim 13, further comprising:

conducting, by the thermally conductive housing, at least a portion of the absorbed heat to a multifunction peripheral associated with the print engine; and dissipating heat, by contact of portions of the electrostatic process unit with the multifunction peripheral, through conduction.

18. The method of claim 17, wherein the print engine is a print engine of a multifunction peripheral.

* * * * *